US011397046B2

(12) United States Patent
Cha et al.

(10) Patent No.: US 11,397,046 B2
(45) Date of Patent: Jul. 26, 2022

(54) HOME APPLIANCE HAVING A MAIN PROCESSOR TO CONTROL POWER TO A SUB-PROCESSOR BASED ON A DOOR STATE, AND CONTROLLING METHOD THEREOF

(71) Applicant: Samsung Electronics Co., Ltd., Suwon-si (KR)

(72) Inventors: Sangyoul Cha, Suwon-si (KR); Yonghan Kim, Suwon-si (KR); Jongchul Choi, Suwon-si (KR); Sucheol Yoo, Suwon-si (KR); Wonjae Yoon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 298 days.

(21) Appl. No.: 16/672,933

(22) Filed: Nov. 4, 2019

(65) Prior Publication Data

US 2020/0141634 A1 May 7, 2020

(30) Foreign Application Priority Data

Nov. 5, 2018 (KR) ..... 10-2018-0134383

(51) Int. Cl.
*F25D 29/00* (2006.01)
*F25D 23/02* (2006.01)

(52) U.S. Cl.
CPC ..... *F25D 29/005* (2013.01); *F25D 23/028* (2013.01); *F25D 2400/36* (2013.01); *F25D 2700/02* (2013.01); *F25D 2700/12* (2013.01)

(58) Field of Classification Search
CPC .... F25D 29/00; F25D 29/005; F25D 2400/36; F25D 2700/02
See application file for complete search history.

(56) References Cited

U.S. PATENT DOCUMENTS

| | | | |
|---|---|---|---|
| 6,546,741 | B2 | 4/2003 | Yun et al. |
| 9,095,167 | B2 | 8/2015 | Lee |
| 9,234,696 | B2 | 1/2016 | Youn et al. |
| 9,234,697 | B2 | 1/2016 | Youn et al. |
| 2002/0038553 | A1 | 4/2002 | Yun et al. |

(Continued)

FOREIGN PATENT DOCUMENTS

| | | |
|---|---|---|
| JP | 9-264659 A | 10/1997 |
| JP | 2004-353993 | 12/2004 |

(Continued)

OTHER PUBLICATIONS

JP 11-201609 (English Translation) (Year: 1999).*

(Continued)

*Primary Examiner* — Jonathan Bradford
(74) *Attorney, Agent, or Firm* — Staas & Halsey LLP

(57) ABSTRACT

A home appliance includes a door sensor; a display; a main processor; a sub-processor configured to control a display operation of the display; and a power control element configured to be connected to the sub-processor, wherein the main processor is configured to: generate a control signal for turning on or off power of the sub-processor based on information sensed by the door sensor, and turn on or off the power of the sub-processor by controlling the power control element according to the control signal.

20 Claims, 10 Drawing Sheets

(56) References Cited

U.S. PATENT DOCUMENTS

| | | | | |
|---|---|---|---|---|
| 2011/0219800 | A1 | 9/2011 | Lee | |
| 2011/0264283 | A1 | 10/2011 | Soh et al. | |
| 2011/0277487 | A1 | 11/2011 | Oh | |
| 2011/0302940 | A1 | 12/2011 | Youn et al. | |
| 2011/0308264 | A1 | 12/2011 | Youn et al. | |
| 2014/0184046 | A1* | 7/2014 | Park | A47B 96/20 312/234 |
| 2014/0230346 | A1 | 8/2014 | Blumberg et al. | |
| 2017/0075853 | A1* | 3/2017 | Seo | H04N 5/63 |
| 2018/0100692 | A1* | 4/2018 | Qiu | B67D 1/06 |
| 2019/0246172 | A1 | 8/2019 | Cheong et al. | |

FOREIGN PATENT DOCUMENTS

| | | |
|---|---|---|
| KR | 0159625 | 1/1999 |
| KR | 10-1999-013166 | 2/1999 |
| KR | 10-2000-0034162 | 6/2000 |
| KR | 10-2001-0113401 | 12/2001 |
| KR | 10-2005-0014518 | 2/2005 |
| KR | 10-2010-0069561 | 6/2010 |
| KR | 10-2018-0050052 | 5/2018 |

OTHER PUBLICATIONS

International Search Report and Written Opinion of the International Searching Authority dated Feb. 18, 2020 in International Patent Application No. PCT/KR2019/014913.
European Extended Search Report for European Patent Application No. 19882482.3 dated Jul. 22, 2021.

* cited by examiner

HOME APPLIANCE HAVING A MAIN PROCESSOR TO CONTROL POWER TO A SUB-PROCESSOR BASED ON A DOOR STATE, AND CONTROLLING METHOD THEREOF

CROSS-REFERENCE TO RELATED APPLICATIONS

This application is based on and claims priority under 35 U.S.C. § 119 to Korean Patent Application No. 10-2018-0134383, filed on Nov. 5, 2018, in the Korean Intellectual Property Office, the disclosure of which is incorporated by reference herein in its entirety.

BACKGROUND

1. Field

Apparatuses and methods consistent with the disclosure relate to a home appliance and a controlling method thereof, and more particularly, to a home appliance that controls power of a display included with the home appliance and a controlling method thereof.

2. Description of the Related Art

A home appliance may include a display capable of displaying a state of the home appliance. For example, a refrigerator may include a display that displays a temperature of a refrigerator compartment and a temperature of a freezer compartment.

When many strands of wires are used between a processor controlling the refrigerator and the display, there is a problem that a structure becomes very complicated. Recent refrigerators solve such a problem by disposing two processors. A sub-processor was disposed separately from a main processor, and the sub-processor was disposed in a position adjacent to the display.

However, when the sub-processor is disposed separately from the main processor, there was a problem that more power is consumed than in the conventional case in which the refrigerator is implemented with only the main processor.

SUMMARY

Embodiments of the disclosure overcome the above disadvantages and other disadvantages not described above. Also, the disclosure is not required to overcome the disadvantages described above, and an embodiment of the disclosure may not overcome any of the problems described above.

The disclosure provides a home appliance that reduces power consumption of the home appliance by changing power of a sub-processor to an off state, and a controlling method thereof.

According to an embodiment of the disclosure, a home appliance includes a door sensor configured to sense whether a door included in the home appliance is opened or closed; a display; a main processor; a sub-processor configured to control a display operation of the display; and a power control element configured to be connected to the sub-processor, wherein the main processor is configured to: generate a control signal for turning on or off power of the sub-processor based on information sensed by the door sensor, and turn on or off the power of the sub-processor by controlling the power control element according to the control signal.

The home appliance may further include a power supply, wherein the power control element may be a switching element disposed between the power supply and the sub-processor, and the main processor may be configured to turn on or off the power of the sub-processor by turning on or off the switching element based on the control signal.

The power control element may be a chip module disposed between the power supply and the sub-processor, and the main processor may be configured to turn on or off the power of the sub-processor by transmitting the control signal to the chip module.

The sub-processor may turn off power of the display based on the control signal for turning off the power of the sub-processor received from the power control element.

The display may be an internal display provided inside the home appliance, and the main processor may be configured to generate a first control signal for turning on the power of the sub-processor based on a door opening operation sensed by the door sensor. The main processor may be configured to generate a second control signal for turning off the power of the sub-processor based on a door closing operation sensed by the door sensor.

The home appliance may further include a motion sensor, wherein the display may be an external display provided outside the home appliance. The main processor may be configured to generate a first control signal for turning on the power of the sub-processor based on an approaching of a user sensed by the motion sensor in a state in which the power of the sub-processor is turned off.

The home appliance may further include an inputter, wherein the sub-processor may be configured to control the display operation of the display based on a user manipulation command input by the inputter.

The main processor may be configured to control the sub-processor to be in a power off state or a low power state in a predetermined first time interval zone.

The main processor may be configured to control the sub-processor to be in a low power state based on a door closing operation sensed by the door sensor in a predetermined second time interval zone.

The home appliance may be implemented as a refrigerator, and the sub-processor may be configured to control the display to display temperature information of the refrigerator.

According to another embodiment of the disclosure, a controlling method of a home appliance including a main processor and a sub-processor controlling a display operation of a display, includes: sensing whether a door included in the home appliance is opened or closed; generating, by the main processor, a control signal for turning on or off power of the sub-processor based on sensing information received from a door sensor; and turning on or off the power of the sub-processor by controlling a power control element according to the control signal.

The power control element may be a switching element disposed between a power supply and the sub-processor, and in the turning on or off of the power of the sub-processor, the power of the sub-processor may be turned on or off by turning on or off the switching element based on the control signal.

The power control element may be a chip module disposed between a power supply and the sub-processor, and in the turning on or off of the power of the sub-processor, the power of the sub-processor may be turned on or off by transmitting the control signal to the chip module.

The controlling method may further include turning off, by the sub-processor, power of the display based on the control signal for turning off the power of the sub-processor received from the power control element.

The display may be an internal display provided inside the home appliance, and in the generating of the control signal, a first control signal for turning on the power of the sub-processor may be generated based on a door opening operation sensed by the door sensor. In the generating of the control signal, a second control signal for turning off the power of the sub-processor may be generated based on a door closing operation sensed by the door sensor.

The display may be an external display provided outside the home appliance. In the generating of the control signal, a first control signal for turning on the power of the sub-processor may be generated based on an approaching of a user sensed by a motion sensor in a state in which the power of the sub-processor is turned off.

The controlling method may further include controlling, by the sub-processor, the display operation of the display based on a user manipulation command input by an inputter.

The controlling method may further include controlling the sub-processor to be in a power off state or a low power state in a predetermined first time interval zone.

The controlling method may further include controlling the sub-processor to be in a low power state based on a door closing operation sensed by the door sensor in a predetermined second time interval zone.

The home appliance may be implemented as a refrigerator, and the controlling method may further include controlling, by the sub-processor, the display to display temperature information of the refrigerator.

BRIEF DESCRIPTION OF THE DRAWINGS

The above and/or other aspects of the disclosure will be more apparent by describing certain embodiments of the present disclosure with reference to the accompanying drawings, in which.

DETAILED DESCRIPTION

Figure 1:
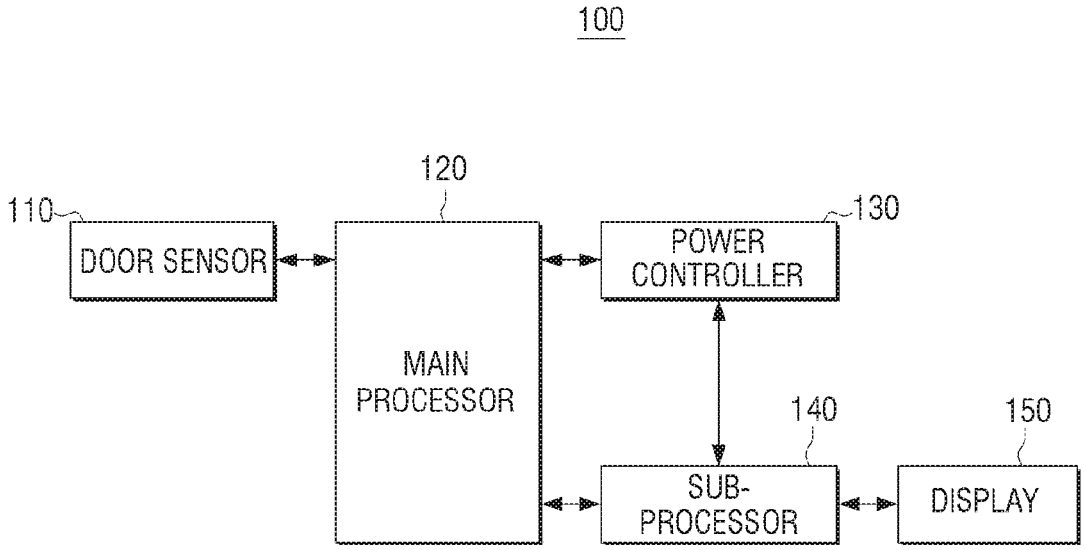
FIG. 1 is a block diagram illustrating a home appliance according to an embodiment of the disclosure.

Before describing the disclosure in detail, a method of describing the specification and drawings will be described.

First, the terms used in the specification and claims have chosen generic terms in consideration of the functions in diverse embodiments of the disclosure. However, these terms may vary depending on the intentions of the artisan skilled in the art, legal or technical interpretation, and emergence of new technologies. In addition, some terms are arbitrarily chosen by the applicant. These terms may be construed as meaning as defined herein, and may be interpreted based on the general contents of the specification and common technical knowledge in the related art, unless otherwise defined.

In addition, like reference numerals or symbols in the drawings attached to the specification denote parts or components that perform substantially the same functions. For convenience of explanation and understanding, different embodiments will be described using the same reference numerals or symbols. That is, although all of the components having the same reference numerals are shown in the drawings, the drawings do not imply one embodiment.

In addition, in the specification and claims, the terms including ordinal numbers such as "first" and "second" may be used to distinguish between the components. These ordinal numbers are used to distinguish the same or similar components from each other, and the meaning of the terms should not be construed as being limited by the use of these ordinal numbers. The terms are used only to distinguish one component from another component. As an example, the components coupled to the ordinal number should not be interpreted as a use order, a layout order, or the like being limited by the number. The respective ordinal numbers are interchangeably used, if necessary.

In the specification, the singular expression includes the plural expression unless the context clearly indicates otherwise. It should be further understood that terms "include" or "constituted" used in the application specify the presence of features, numerals, steps, operations, components, parts mentioned in the specification, or combinations thereof, but do not preclude the presence or addition of one or more other features, numerals, steps, operations, components, parts, or combinations thereof.

Because the disclosure may be variously modified and have several embodiments, specific embodiments will be illustrated in the drawings and be described in detail in the detailed description. However, it is to be understood that the disclosure is not limited to the specific embodiments, but includes all modifications, equivalents, and substitutions without departing from the scope and spirit of the disclosure. When it is decided that a detailed description for the known art related to the disclosure may obscure the gist of the disclosure in describing the embodiments, the detailed description will be omitted.

A term "module", "unit" "part", or the like, in the embodiment of the disclosure is a term for referring to the component performing at least one function or operation, and such a component may be implemented in hardware or software or a combination of hardware and software. In addition, a plurality of "modules", "units", "parts", or the like may be integrated into at least one module or chip and may be implemented in at least one processor, except for a case in which they need to be each implemented in individual specific hardware.

In addition, in the embodiment of the disclosure, it will be understood that when an element is referred to as being "connected to" another element, this includes not only a direct connection but also an indirect connection through another medium. In addition, unless explicitly described otherwise, "comprising" any components will be understood to imply the inclusion of other components but not the exclusion of any other components.

FIG. 1 is a block diagram illustrating a home appliance according to an embodiment of the disclosure.

A home appliance 100 may include a door sensor 110, a main processor 120, a power control element 130, a sub-processor 140, and a display 150.

Meanwhile, the home appliance 100 may be various devices including a display. For example, the home appliance 100 may be various electronic devices including a display for displaying specific information and content such as a refrigerator, a TV, a washing machine, a dryer, an air conditioner, an air purifier, and the like.

The door sensor 110 may be a sensor capable of identifying an opening or closing of a door attached to (included in) the home appliance 100. In addition, the door sensor 110 may generate information corresponding to the opening or closing of the door, and may transmit the generated sensing information to the main processor 120.

The door sensor 110 may detect whether a refrigerator compartment door or a freezer compartment door of the refrigerator is opened or closed. The door sensor 110 may be implemented to generate an event and output data when a user opens the door. Specifically, the door sensor 110 may check whether physical configurations are in contact with each other to check whether the door is opened or closed. For example, it is assumed that a configuration A and a configuration B are in contact with each other when the door is in a closed state, and the configuration A and the configuration B are not in contact with each other when the door is in an opened state. Here, when the state of the door is changed from the state in which the configuration A and the configuration B are in contact with each other to the state in which the configuration A and the configuration B are not in contact with each other, the door sensor 110 may generate data corresponding to a predetermined event and transmit the data to the main processor 120. According to another embodiment, the door sensor 110 may be implemented to use a front camera 151 or an internal camera 152. The door sensor 110 may sense whether the door is opened or closed by using a change in an image captured by the camera. The main processor 120 may perform an overall control operation of the home appliance 100. Specifically, the main processor 120 functions to control an overall operation of the home appliance 100.

Meanwhile, although the door sensor 110 has been described as performing an operation of identifying whether the door is opened or closed, the door sensor 110 may identify time information according to the sensed opening and closing of the door. For example, when the user has opened the door for 10 seconds, the door sensor 110 may identify that the opened state of the door lasted for 10 seconds. Here, although the door sensor 110 has been described as identifying the time information according to the opening and closing of the door, it may be implemented by the main processor 120 in an actual implementation.

The main processor 120 may be implemented as a digital signal main processor (DSP) 120, a micro-main processor 120, or a time controller (TCON) processing a digital image signal. However, the main processor 120 is not limited thereto, but may include one or more of a central processing unit (CPU), a micro controller unit (MCU), a micro processing unit (MPU), a controller, an application main processor (AP) 120, a communication main processor (CP) 120, and an ARM main processor 120, or may be defined as the corresponding term. In addition, the main processor 120 may be implemented by a system-on-chip (SoC) or a large scale integration (LSI) in which a processing algorithm is embedded, and may be implemented in the form of a field programmable gate array (FPGA).

The power control element 130 may be an element controlled by the main processor 120. Specifically, the power control element 130 may be an element connected to the sub-processor 140 to supply power. When the power control element 130 is in an on state, the sub-processor 140 may be supplied with the power. However, when the power control element 130 is in an off state, the sub-processor 140 may not be supplied with the power. Whether the power control element 130 supplies the power to the sub-processor 140 may be controlled by the main processor 120.

Meanwhile, the power control element 130 may correspond to any one of a switch, a relay, and a diode. In addition, the power control element 130 may be a driver integrated circuit (IC).

The sub-processor 140 may control an operation of the display 150. Specifically, the sub-processor 140 may control power of the display 150 to be an on or off state. In addition, the sub-processor 140 may perform a control to change a mode of the display 150 to a power saving mode. In addition, the sub-processor 140 may receive information displayed on the display 150 from the main processor 120 and transmit the received information to the display 150. In addition, the sub-processor 140 may transmit information related to an operation performed by the sub-processor 140 to the main processor 120.

The sub-processor 140 may be the same processor chip as the main processor 120. However, the sub-processor 140 may be a processor chip with less processing capacity than the main processor 120. In addition, the sub-processor 140 may be connected to the power control element 130 to receive the power from the power control element 130.

The display 150 may be implemented as various types of displays such as a liquid crystal display (LCD), a light-emitting diode (LED), an organic light emitting diode (OLED) display, a plasma display panel (PDP), a touch screen, and the like.

The display 150 may also include a driving circuit, a backlight unit, and the like which may be implemented in the form of an a-si TFT, a low temperature poly silicon (LTPS) TFT, and an organic TFT (OTFT). In addition, the display 150 may also be implemented as a flexible display.

Meanwhile, the display 150 may include a touch sensor for detecting a touch gesture of the user. The touch sensor may be implemented as various types of sensors such as a capacitive type, a resistive type, a piezoelectric type, and the like. The capacitive type uses a dielectric coated on a surface of the display 150 to calculate a touch coordinate by detecting micro electricity excited to a body of the user when a portion of the body of the user touches the surface of the display 150. The resistive type uses a scheme of calculating a touch coordinate by detecting that a current flows due to a contact between two electrode plates embedded in the display 150 at a touched point in the case in which the user touches the screen. In addition, when the user terminal device also supports a pen input function, the display 150 may detect a user gesture using an input means such as a pen in addition to the user's finger. When the input means is a stylus pen including a coil therein, the user terminal device may also include a magnetic field detecting sensor capable of detecting a magnetic field changed by the coil inside the stylus pen. Accordingly, not only touch gestures but also proximity gestures, that is, hovering may be detected.

The main processor 120 may generate a control signal for turning on or off the power of the sub-processor 140 based on the information sensed by the door sensor 110, and may turn on or off the power of the sub-processor 140 by controlling the power control element 130 according to the control signal.

It is assumed that the power of the sub-processor 140 usually remains in an off state. In this case, when the main processor 120 receives information from the door sensor 110 that the user has opened the door, the main processor 120 generates a control signal for changing the power of the sub-processor 140 from the off state to the on state. The main processor 120 may transmit the generated control signal to the power control element 130. In addition, the power control element 130 may supply the power to the sub-processor 140 based on the received control signal. If the sub-processor 140 is supplied with the power, a power state of the sub-processor 140 may be changed from the off state to the on state.

On the other hand, when the main processor 120 receives information from the door sensor 110 that the user has closed the door, the main processor 120 generates a control signal for changing the power of the sub-processor 140 from the on state to the off state. The main processor 120 may transmit the generated control signal to the power control element 130. In addition, the power control element 130 may not supply the power to the sub-processor 140 based on the received control signal. If the sub-processor 140 is not supplied with the power, the power state of the sub-processor 140 may be changed from the on state to the off state.

On the other hand, the home appliance 100 may further include a power supply 195. According to an embodiment, the power control element 130 may be implemented as a switching element disposed between the power supply 195 and the sub-processor 140. In this case, the main processor 120 may turn on or off the power of the sub-processor 140 by turning on or off the switching element based on the control signal. Here, the switching element may refer to any one of a switch, a relay, and a diode.

For example, it is assumed that the main processor 120 changes the power state of the sub-processor 140 to the on state. The main processor 120 may turn on the power control element 130, which is the switching element. When the power control element 130 is in an on state, it may mean that the power is transferred from the power supply 195 to the sub-processor 140. In addition, when the power control element 130 is in an off state, it may mean that the power is not transferred from the power supply 195 to the sub-processor 140. In the case of a switch, a state in which the switch is closed may be an on state, and a state in which the switch is opened may be an off state.

According to another embodiment, the power control element 130 may be implemented as a chip module disposed between the power supply 195 and the sub-processor 140. In this case, the main processor 120 may turn on or off the power of the sub-processor 140 by transmitting the control signal to the chip module. The chip module may correspond to a driver integrated circuit (IC).

For example, in a case in which the power control element 130 is implemented as the driver IC, the power control element 130 may determine whether to supply the power to the sub-processor 140 based on the control signal received from the main processor 120. For example, in a case in which the power control element 130 is implemented to perform a function of supplying or interrupting the power supplied from the power supply 195 to the sub-processor 140, the power control element 130 may supply or interrupt the power supplied from the power supply 195 based on the control signal received from the main processor 120.

On the other hand, when a control signal for turning off the sub-processor 140 is received from the power control element 130, the sub-processor 140 may turn off power of the display 150. For example, the sub-processor 140 may change the power of the display 150 to the off state and may also change own power state to the off state.

Meanwhile, the display 150 may be an internal display 150 provided inside the home appliance 100. In this case, when the door sensor 110 senses a door opening operation, the main processor 120 may generate a first control signal for turning on the power of the sub-processor 140. For example, it is assumed that the sub-processor 140 is in the off state. When the user opens the door, the main processor 120 may generate the first control signal for changing the power of the sub-processor 140 from the off state to the on state.

In addition, when the door sensor 110 senses a door closing operation, the main processor 120 may generate a second control signal for turning off the power of the sub-processor 140. For example, when the user closes the door, the main processor 120 may generate the second control signal for turning off the power of the sub-processor 140 after a predetermined time.

Here, a point of time at which the power state of the display 150 is turned off and a point of time at which the power state of the sub-processor 140 is turned off may be different from each other. For example, after the user closes the door, the display 150 may be turned off after a predetermined time (5 seconds) and the sub-processor 140 may be turned off after a predetermined time (1 minute). The reason for the time difference is that it may be inefficient to change the power of the sub-processor 140 to the on or off state every time the door is opened or closed.

It is assumed that the user has opened and closed the door of the refrigerator four times during one minute. In this case, the power consumed to open and close the power of the sub-processor 140 four times during one minute may be high. Therefore, in order to reduce power consumption, the power state of the sub-processor 140 may be kept on for a predetermined time (1 minute), and only the power state of the display 150 may be changed to the on or off state. Here, the predetermined time (1 minute or 5 seconds) is only an example and may be changed according to a setting of the user.

Meanwhile, the home appliance 100 may further include a motion sensor and the display 150 may be an external display 150 provided outside the home appliance 100. In addition, in the state in which the power of the sub-processor 140 is turned off, when the motion sensor senses an approaching of the user, the main processor 120 may generate a first control signal for turning on the power of the sub-processor 140.

The motion sensor may be implemented in the form of a proximity sensor 161. The proximity sensor 161, which is a sensor that detects an object without contact, may detect the presence of an object near the refrigerator, and the proximity sensor 161 may be implemented as an optical proximity sensor, a capacitive proximity sensor, an inductive proximity sensor, or the like. In addition, the proximity sensor 161 may be an IR proximity sensor.

According to still another embodiment, the motion sensor may be a sensor for detecting the movement of the object. In addition, the motion sensor may be implemented to use the front camera 151 or the internal camera 152. For example, the motion sensor may detect the movement of the user by detecting the image captured by the camera.

For example, when the user approaches the home appliance 100, the motion sensor may detect the approaching of the user. In addition, the motion sensor may transmit corresponding information to the main processor 120. The main processor 120 may identify whether to change the power of the sub-processor 140 to the on state based on the received sensing information.

Meanwhile, if the power of the sub-processor 140 is changed to the on state whenever the user approaches the home appliance 100, power consumption may be high. Therefore, the main processor 120 needs to analyze an approaching intention of the user sensed from the motion sensor. The main processor 120 may use at least one of whether the user is approaching, approaching speed, approaching direction, or approaching frequency to analyze the approaching intention of the user. Whether the user is approaching, approaching speed, approaching direction, or approaching frequency may be identified by sensing information received from the motion sensor.

For example, when the approaching speed of the user approaching the home appliance 100 is reduced, the main processor 120 may generate a control signal for changing the power of the sub-processor 140 to the on state. If the motion sensor of the home appliance 100 senses that the approaching speed of the user is reduced, it may be expected that the user uses the home appliance 100 by reducing the speed in front of the home appliance 100. Therefore, the main processor 120 may generate the control signal to turn on the power of the sub-processor 140 only when the approaching speed of the user is reduced. A case in which the approaching speed of the user approaching the home appliance 100 increases may correspond to a case in which the user passes the home appliance 100 instead of using the refrigerator.

Here, if the power the sub-processor 140 is changed to the on state, the power of the display 150 may be kept in the off state. When the power of the sub-processor 140 is turned on, it means that the display 150 may be controlled and does not necessarily mean that the power of the display 150 is changed to the on state.

When the motion sensor senses the approaching of the user, the main processor 120 may change only the power of the sub-processor 140 to the on state and maintain the power of the display 150 in the off state. In addition, when the motion sensor identifies that the user stays in front of the home appliance 100 for a predetermined time, the main processor 120 may control to change the power of the display 150 to the on state. For example, when the user comes to the front of the refrigerator, the power of the sub-processor 140 may be changed to the on state, and when the user stands in front of the refrigerator for 3 seconds or more, the power of the display 150 may be changed to the on state.

Meanwhile, the main processor 120 may identify a height of the user by using the information sensed by the motion sensor. In addition, the main processor 120 may control to change the power of the sub-processor 140 to the on state only when the height of the user is a predetermined value or more. For example, the main processor 120 may control to change the power of the sub-processor 140 to the on state only when the height of the user approaching the refrigerator is 140 cm or more. In general, the user using the display of the refrigerator may be an adult. Therefore, when the children approach the refrigerator, it is determined that the display is not used, and thus the main processor 120 may maintain the power of the sub-processor 140 in the off state. In addition, as the time for which the power of the sub-processor 140 is maintained in the off state is increased, power consumption may be reduced. Here, the predetermined value may be changed by the user. As another implementation, the main processor 120 may control to change the power of the sub-processor 140 to the on state when it is determined that the height of the user is between a specific value (140 cm) and another specific value (220 cm).

Meanwhile, the main processor 120 may identify whether to change the power state of the sub-processor 140 based on the approaching direction of the user. For example, it is assumed that there is a laundry room on the left side of the refrigerator and a dining table on the right side thereof. A case in which the user uses the refrigerator may correspond to a case in which the user approaches the refrigerator from the dining table. Therefore, the main processor 120 may control to change the power of the sub-processor 140 to the on state only when the user approaches from the right side.

In addition, when the case in which the user approaches from the right side is a predetermined ratio (90%) or more, the main processor 120 may control to turn on the power of the sub-processor 140.

Here, the approaching direction may be changed by the setting of the user, and the main processor 120 may learn and determine the approaching direction by itself by analyzing a usage pattern of the user.

Meanwhile, the home appliance 100 may further include an inputter, or interface, and the sub-processor 140 may control a display operation of the display 150 based on a user manipulation command input by the inputter. The user may input various commands for controlling the home appliance 100 through the inputter.

Meanwhile, the main processor 120 may control the sub-processor 140 to be in a power off state or a low power state in a predetermined first time interval zone. For example, the main processor 120 may control the sub-processor 140 to be turned off or in a low power state in a time interval zone from 12 am to 7 am.

Here, the first time interval zone may be changed by the setting of the user and may be learned by itself through artificial intelligence learning. For example, the main processor 120 may check the time when the user uses the home appliance 100 for one month and control the sub-processor 140 to be turned off or in the low power state in a time interval in which the user does not use the home appliance 100.

In addition, when the door sensor 110 senses the door closing operation in a predetermined second time interval zone, the main processor 120 may control the sub-processor 140 to be in the low power state. The main processor 120 may not change the power state of the sub-processor 140 to the off state in all cases in which the door closing operation is sensed.

Rather, when the power state of the sub-processor 140 is frequently changed, power consumption may be large. Therefore, the main processor 120 may control the sub-processor 140 to be in the power off state or the low power state only when the door closing operation is sensed in the second time interval zone. For example, it is assumed that the door closing operation is sensed between 1 am and 6 am. Because the refrigerator is rarely used at dawn, the door opening operation may be less likely to be sensed again after the door closing operation. Therefore, when the door closing operation is sensed between 1 am and 6 am, the power of the sub-processor 140 may be immediately changed to the off state, thereby reducing power consumption.

Meanwhile, the home appliance 100 may be implemented as a refrigerator, and the sub-processor 140 may control the display 150 to display temperature information of the refrigerator. In addition to the temperature information of the refrigerator, the display 150 attached to the refrigerator may display various information such as an operation function and an operation mode of the refrigerator.

Meanwhile, in the description of the home appliance 100 according to an embodiment of the disclosure, the case in which only one of the door sensor 110 or the motion sensor is used has been described. However, this is only one example, and both the door sensor 110 and the motion sensor may be used in actual implementation.

The main processor 120 may use both the door sensor 110 and the motion sensor to control the external display attached to the outside of the home appliance 100. For example, when the user approaches the refrigerator, the main processor 120 may change the power of the sub-processor 140 to the on state and control the display 150 to be maintained in the off state. In addition, when the user opens the door of the refrigerator, the main processor 120 may change the power of the display 150 to the on state.

Meanwhile, the disclosure has described an operation of determining whether to turn on or off the power of the sub-processor 140 using the door sensor 110 or the motion sensor. However, according to another embodiment, a fingerprint sensor 163 or a pressure sensor 164 may be used instead of the motion sensor.

Specifically, the main processor 120 may determine whether to turn on or off the power of the sub-processor 140, based on information sensed by the fingerprint sensor 163 or the pressure sensor 164. For example, when a pre-stored fingerprint of the user is recognized through the fingerprint sensor 163 or a change in pressure is detected by the pressure sensor 164, the main processor 120 may determine to change the power of the sub-processor 140 to the on state. If the power of the sub-processor 140 is changed to the on or off state whenever the display 150 is changed to the on or off state, power consumption may be larger. Therefore, whether to maintain the power state of the sub-processor 140 in the on or off state may be an important issue in terms of power consumption.

In addition, even though there is little difference in power consumption, it may take a certain time to change the power of the display to the on state when the power of the sub-processor 140 is turned off. In this case, the user may feel inconvenience. Therefore, it is necessary to determine whether to maintain the power state of the sub-processor 140 in the on state or the off state to minimize the inconvenience that the user feels.

When the power of the sub-processor 140 is always in the on state for convenience of the user, power consumption may be large. Therefore, the main processor 120 may identify whether to change the power of the sub-processor 140 to the on or off state based on the sensing information received from the door sensor 110 or the motion sensor. In addition, overall power consumption may be reduced by changing the power state of the sub-processor 140 according to the identified result.

The home appliance 100 may be implemented as the refrigerator. A detailed configuration of the refrigerator will be described with reference to FIGS. 2 to 4.

Figure 2:
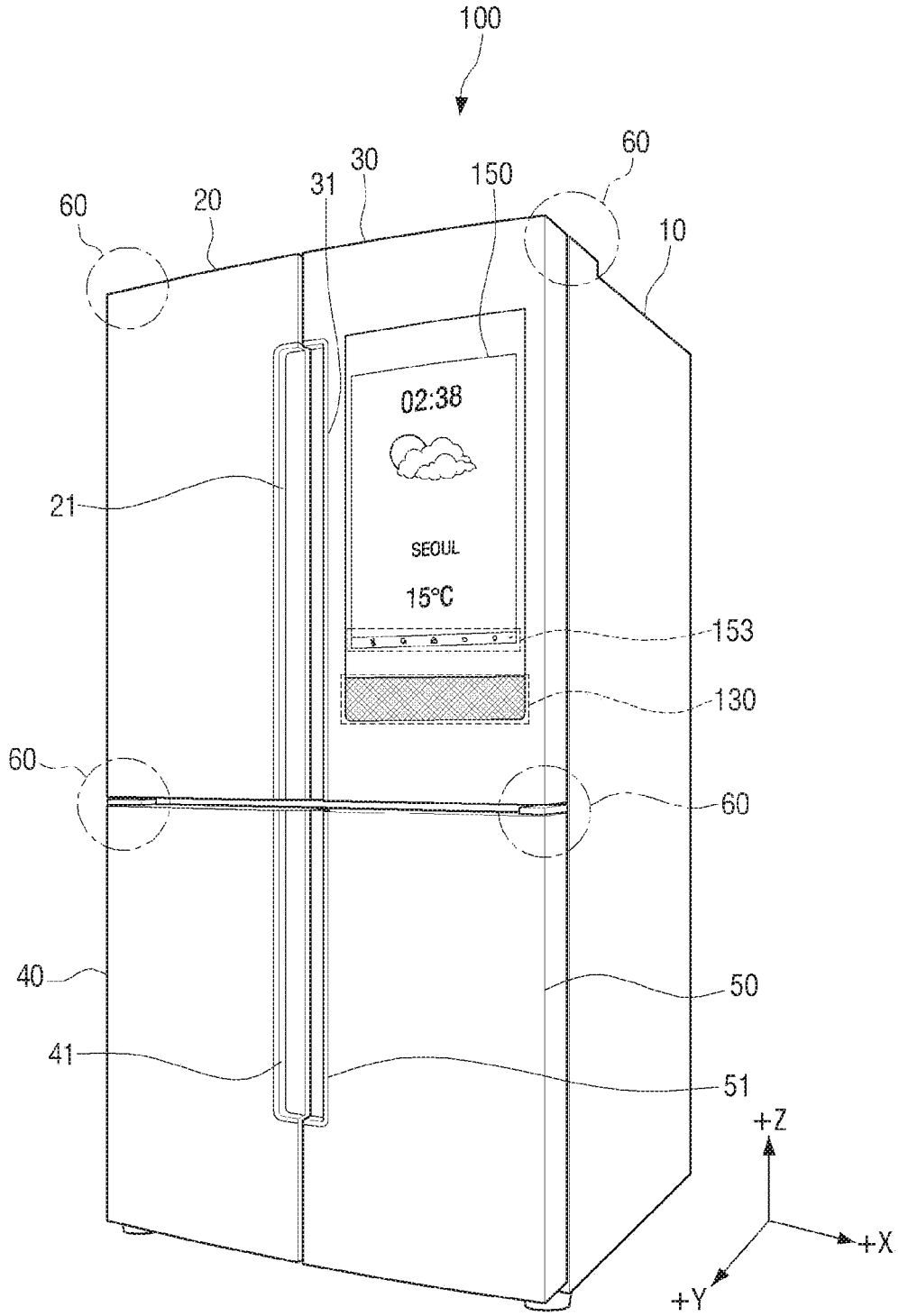
FIG. 2 is a schematic perspective view illustrating a refrigerator according to an embodiment of the disclosure.
Figure 3:
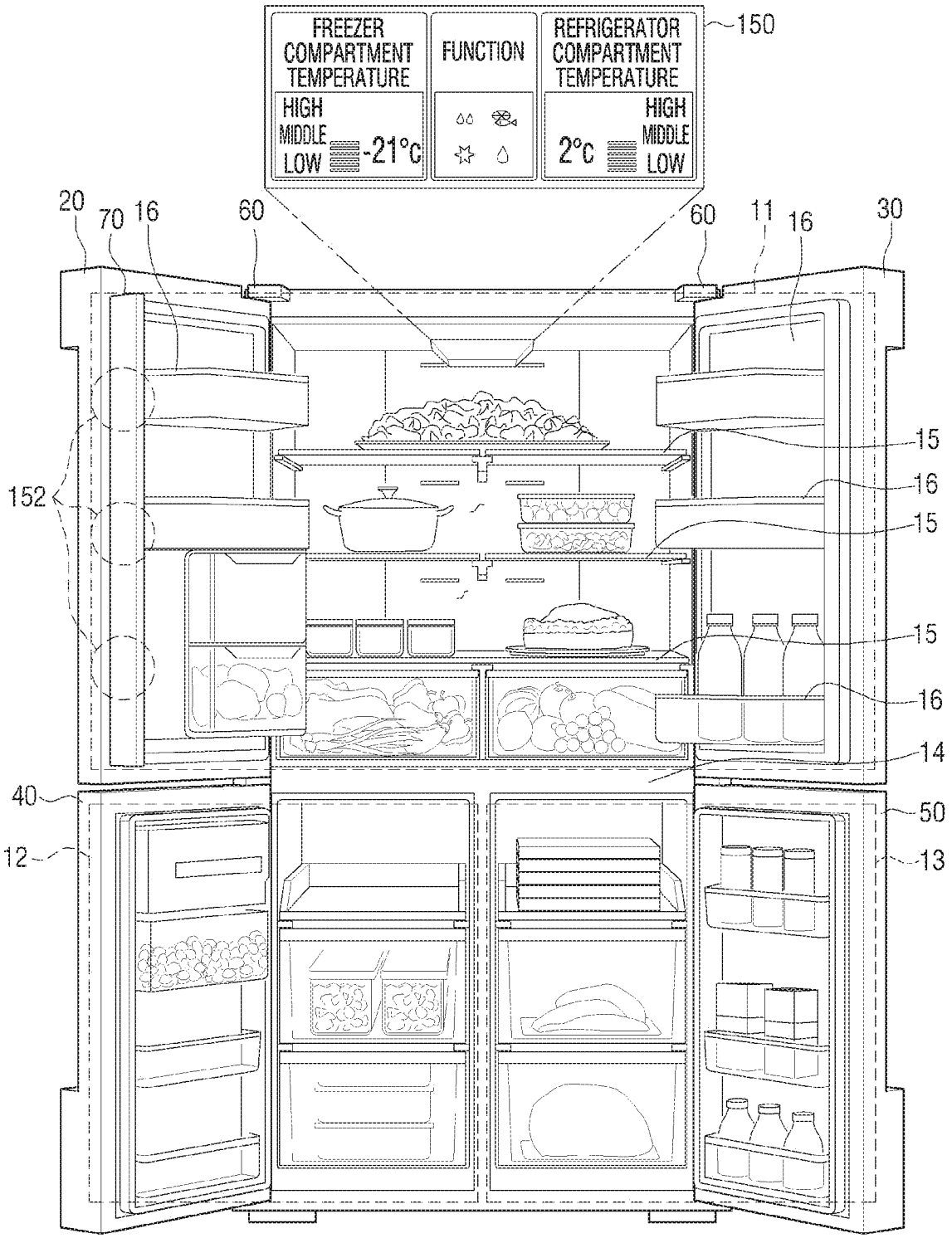
FIG. 3 is a schematic front view illustrating a refrigerator of which all doors are opened according to an embodiment of the disclosure.

Referring to FIGS. 2 and 3, the refrigerator may include a main body 10, storage compartments 11, 12, and 13, a plurality of doors 20, 30, 40, and 50, and hinges 60 connecting the doors 20 to 50 to the main body 10. The number of four doors is merely one example, and the number of doors may be one, two, three, or the like.

The display 150 may be located on at least one door (e.g., at least one of the left door 20 and the right door 30) of the plurality of doors 20, 30, 40, and 50. The display 150 may be a touch screen that may receive a touch input.

A speaker 141 may be located in at least one of the plurality of doors 20, 30, 40, and 50. The speaker 141 is a component that may output audio.

A front camera (or first camera) 151 (see FIG. 4) may be disposed on at least one of the plurality of doors 20, 30, 40, and 50. In addition, the proximity sensor 161 (see FIG. 4) may be located on at least one of the plurality of doors 20, 30, 40, and 50. In addition, a microphone 142 (see FIG. 4) may be located on at least one of the plurality of doors 20, 30, 40, and 50.

The fingerprint sensor 163 (see FIG. 4) may be disposed on at least one of the plurality of doors 20, 30, 40, and 50. For example, the fingerprint sensor 163 (see FIG. 4) may be disposed on at least one of a plurality of handles 21, 31, 41, and 51.

The main body 10 may include an inner case (not illustrated) forming the storage compartments 11 to 13, an outer case (not illustrated) forming an exterior of the refrigerator, and an insulator (not illustrated) maintaining a temperature difference between the inner case and the outer case. The insulator (not illustrated) may prevent the outflow of cold air inside the storage compartments 11 to 13 to the outside and prevent the inflow of external warmth into the storage compartments 11 to 13.

The main body 10 may include a cold air supply unit (not illustrated) for supplying cold air to the storage compartments 11 to 13. The cold air supply unit (not illustrated) may include a compressor 181 for compressing a refrigerant (see FIG. 4), a condenser (not illustrated), an expansion valve (not illustrated), an evaporator (not illustrated), and a pipe (not illustrated).

The storage compartments 11 to 13 may be divided into a partition 14. The storage compartments 11 to 13 may be divided into lower freezer storage compartments 12 and 13 (hereinafter referred to as "freezer compartments") and a refrigerator storage compartment 11 (hereinafter referred to as "refrigerator compartment") above the freezer compartments 12 and 13.

The refrigerator compartment 11 of the storage compartments 11 to 13 divided by the partition 14 may include one or a plurality of shelves 15 and one or a plurality of storage boxes 16.

The refrigerator compartment 11 may be coupled to a first door 20 of one side (e.g., the left side) of the refrigerator compartment 11, and a second door 30 adjacent to the first door 20 and located at the other side (e.g., the right side) of the storage compartment 11.

A dispenser (not illustrated) for providing water, ice, or sparkling water and/or a grippable handle 21 may be located on a front surface of the first door 20 (e.g., in a +y axis direction). The second door 30 may include a grippable handle 31. The handle 21 of the first door 20 and the handle 31 of the second door 30 may be positioned to be spaced apart from each other to the left and right sides with respect to the center area of the refrigerator compartment 11.

A rotating bar 70 may be rotatably mounted to the first door 20.

The rotating bar 70 may be rotatably coupled to the first door 20 to seal a gap between the first door 20 and the second door 30. It is also possible to apply the rotating bar 70 to the second door 30.

At least one internal camera (or second camera) 152 may be disposed on the rotating bar 70. The internal camera 152 may face the refrigerator compartment 11 when the rotating bar 70 is in a position to seal the gap between the first door 20 and the second door 30. Therefore, even if the first door 20 and the second door 30 are not opened, the inside of the refrigerator compartment 11 may be viewed through the internal camera 152.

A display 150 capable of displaying a function of the refrigerator and stored settings, receiving a user input, and displaying an application (or widget) screen may be located on a front surface (e.g., in a +y axis direction) of the second door 30. A task bar 153 may be included in the display 150 or may be separated from the display 150. The task bar 153 may be a soft button included in the touch screen or a physical button separated from the touch screen. The task bar 153 may include, for example, a microphone key, a menu key, a home key, a back key, and a notification key. When the microphone key is pressed, the microphone 142 may be turned on or off. When the menu key is pressed, menus available in a running application may be displayed, or a currently running program may be displayed. When the home key is pressed, it is possible to return to a home screen. When the back key is pressed, it is possible to return to a previous screen. When the notification key is pressed, a list of notifications may be displayed, W-Fi may be turned on or off, and brightness and volume of the screen may be adjusted.

According to an embodiment, the speaker 141 may be disposed below the display 150 based on the display 150, and two microphones 142 (see FIG. 4) may be embedded in the upper left and right of the display 150.

The freezer compartment 12 may have a third door 40 on one side thereof. In addition, the freezer compartment 13 may have a fourth door 50 on one side thereof. The freezer compartments 12 and 13 may be combined into one storage compartment (e.g., like the refrigerator compartment 11). One freezer compartment may have doors on the left and right sides, respectively, like the refrigerator compartment 11. In this case, the third door 40 or the fourth door 50 may have a rotating bar like the refrigerator compartment 11, and the rotating bar may include an internal camera disposed to capture the inside of the freezer compartments 12 and 13.

The third door 40 may include a grippable handle 41. The fourth door 50 may include a grippable handle 51. The handle 41 of the third door 40 and the handle 51 of the fourth door 50 may be positioned to be spaced apart from each other to the left and right sides with respect to the center area of the freezer compartments 12 and 13.

Meanwhile, referring to FIG. 3, the display 150 may be disposed inside the refrigerator. The refrigerator may display at least one of a freezer compartment temperature, a refrigerator compartment temperature, an operation mode of the refrigerator, or a function performed by the refrigerator on an internal display.

In describing the internal display, the internal display has been described as being installed inside the refrigerator compartment. However, according to another embodiment, the internal display may be installed inside the freezer compartment. In addition, a display for displaying the refrigerator compartment temperature may be disposed inside the refrigerator compartment, and a display for displaying the freezer compartment temperature may be disposed inside the freezer compartment.

Figure 4:
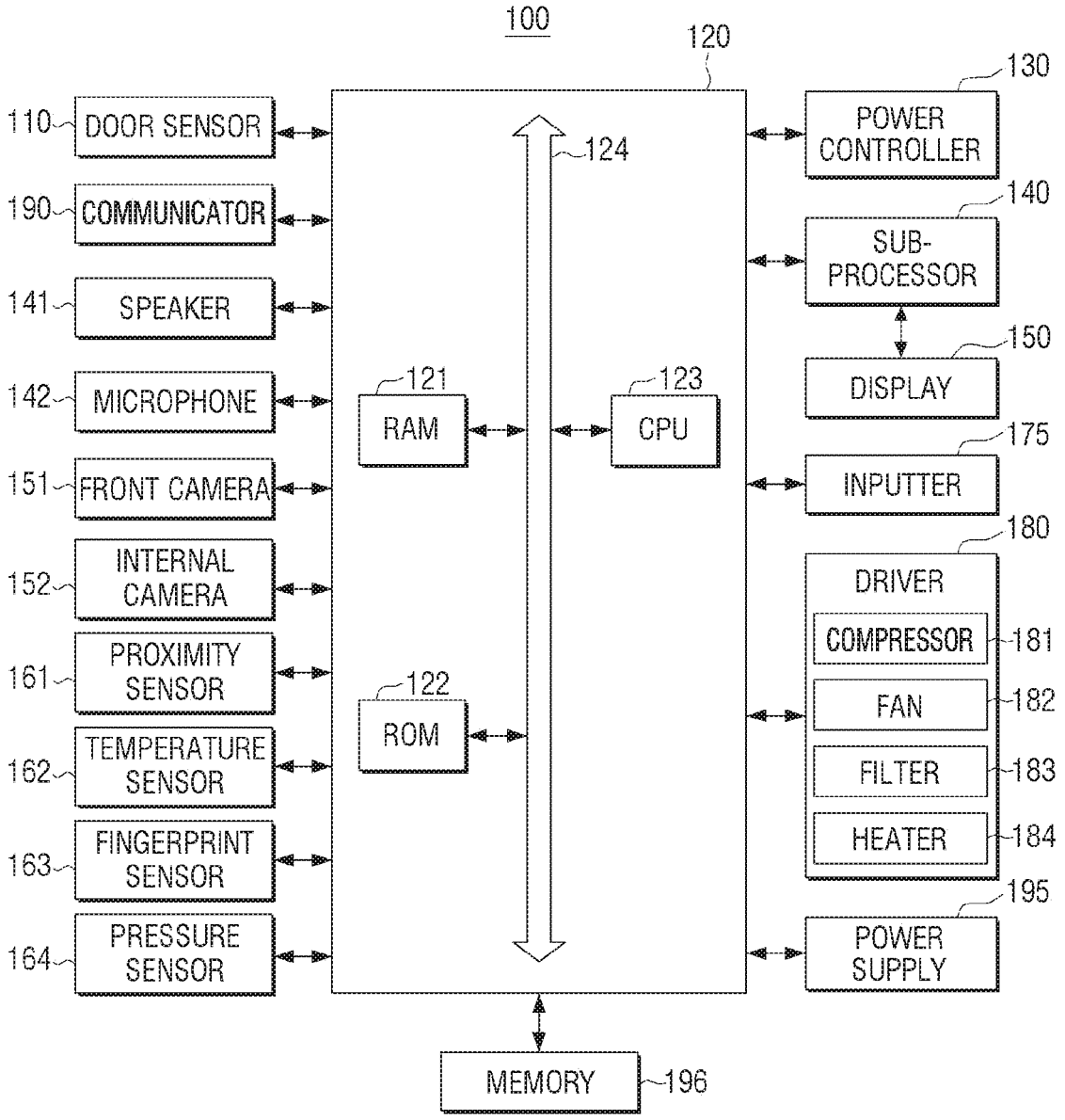
FIG. 4 is a block diagram illustrating components of the refrigerator according to an embodiment of the disclosure.

FIG. 4 is a block diagram illustrating components of the refrigerator according to an embodiment of the disclosure.

Referring to FIG. 4, the refrigerator may include the door sensor 110, the main processor 120, the power control element 130, the sub-processor 140, the display 150, a memory 196, the speaker 141, the microphone 142, the front camera 151, the internal camera 152, the proximity sensor 161, the temperature sensor 162, the fingerprint sensor 163, the pressure sensor 164, the inputter 175, a driver 180, a communicator 190, and the power supply 195. Depending on the embodiment, although not shown, appropriate hardware/software components of a level apparent to those skilled in the art may be further included in the refrigerator. In addition, although the component is illustrated, it may be excluded from the refrigerator according to the embodiment.

The main processor 120 is a component for controlling an overall operation of the refrigerator 120. The main processor 120 performs a function of controlling a signal flow between the internal components of the refrigerator and processing data. For example, the main processor 120 may drive an operating system or an application to control a plurality of hardware or software components connected to the main processor 120, and perform various kinds of data processing and calculation.

The main processor 120 may include a random access memory (RAM) 121, a read only memory (ROM) 122, a central processing unit (CPU) 123, and a bus 124. The RAM 121, the ROM 122, the CPU 123, and the like may be connected to each other through the bus 124.

The RAM 121 may be used as a storage area for various tasks performed in the refrigerator. The RAM 121 may be used as a storage area for control information received from the outside, operation information of the refrigerator, or state information of the refrigerator. The ROM 122 may store a control program for controlling the refrigerator.

The main processor 120 may be implemented as at least one general processor, a digital signal processor, an application specific integrated circuit (ASIC), a system on chip (SoC), a microcomputer (MICOM), or the like.

The main processor 120 may control the communicator 190, the speaker 141, the microphone 142, the front camera 151, the internal camera 152, the proximity sensor 161, the temperature sensor 162, the fingerprint sensor 163, the pressure sensor 164, the display 150, the inputter 175, the driver 180, the memory 196, and the power supply 195.

The refrigerator may be connected to an external device through the communicator 190. The external device may be, for example, a mobile device 200, a server 300, or a home appliance (e.g., an air conditioner, a washing machine, or a TV).

The communicator 190 may establish a communication network using a wired or wireless communication method. The refrigerator may communicate with the external device through a mobile communication network, a wireless LAN communication network, or a local area communication network. The wireless LAN communication may be wirelessly connected to an access point AP in a place where the AP is installed. The wireless LAN communication may include, for example, W-Fi communication. Local area communication may include Bluetooth communication, Bluetooth low energy communication, Wi-Fi direct, Infrared data association (IrDA) communication, ultra-wideband (UWB) communication, magnetic secure transmission (MST) communication, and/or near field communication (NFC).

The refrigerator may transmit operation information corresponding to an operation of the refrigerator (e.g., temperature control of each storage compartment, etc.) or state information corresponding to a state of the refrigerator (e.g., normal or abnormal) to the external device, or receive control information (e.g., a control command corresponding to rapid freezing of the refrigerator) from the outside through the communicator 190.

The speaker 141 may output sound corresponding to various signals (e.g., a wireless signal, a broadcast signal, an audio source, a video file, or a picture capture). The number of speakers 141 may be one or plural.

One or a plurality of speakers 141 may be located on the front and/or side surfaces of the refrigerator. According to an embodiment, the speaker 141 may be disposed to be adjacent to the display 150 as illustrated in FIG. 2.

According to an embodiment of the disclosure, the speaker 141 may output auditory feedback regarding an indication of a storage position of the food in the storage compartment.

The microphone 142 may generate (or convert) a voice or sound received from the outside into an electrical signal. The electrical signal generated by the microphone 142 may be stored in the memory 196 or output through the speaker 141. The number of microphones 142 may be one or plural.

The front camera (or the first camera 151) and the internal camera (or the second camera 152) may capture a still image or a video.

The front camera 151 may be disposed to capture the front surface of the refrigerator. The main processor 120 may identify the user based on a face of the user included in the image captured by the user through the front camera 151. In addition, before the user puts the food into the refrigerator, the food may be captured through the front camera 151, and the main processor 120 may identify foods included in the captured image and record which foods are stored in the refrigerator.

The internal camera 152 may be disposed to capture at least one of the storage compartments 11, 12, and 13. The internal camera 152 may be disposed at any position as long as the interior of the storage compartments 11, 12, and 13 may be captured in a state in which the doors 20, 30, 40, and 50 are closed.

According to an embodiment, one or a plurality of internal cameras 152 may be located behind the doors 20, 30, 40, and 50. For example, one or a plurality of internal cameras 152 may be located behind the doors 20 and 30 facing the storage compartment 11. In addition, one or a plurality of internal cameras 152 may be located behind the door 40 facing the storage compartment 12. In addition, one or a plurality of internal cameras 152 may be located behind the door 50 facing the storage compartment 13.

According to an embodiment, as described in FIG. 3, the internal camera 152 may be disposed on the rotating bar 70 to seal between the doors.

The internal camera 152 may be disposed on inner walls of the storage compartments 11, 12, and 13.

The internal camera 152 may be a 3D camera capable of obtaining a depth map. Alternatively, it is also possible to obtain the depth map through stereo matching using two internal cameras 152. A relative position of each object in the captured image may be identified through the depth map.

The main processor 120 may store an image captured by one of the front camera 151 and the internal camera 152 in the memory 196.

The proximity sensor 161 may be used to detect the presence of an object near the refrigerator as a sensor for detecting an object without contact. The proximity sensor 161 may be disposed in front of at least one of the doors 20, 30, 40, and 50, and one or a plurality of proximity sensors 161 may be disposed. The proximity sensor 161 may be implemented as, for example, an optical proximity sensor, a capacitive proximity sensor, an inductive proximity sensor, or the like. The proximity sensor 161 may be an IR proximity sensor.

The approaching of the object may be detected not only through the proximity sensor 161 but also through the front camera 151 or the microphone 142.

The temperature sensor 162 may be used to detect the temperature of the storage compartment of the refrigerator.

The proximity sensor 161 may be located in front of the door of the refrigerator. The temperature sensor 162 may be located in the storage compartment.

The fingerprint sensor 163 may be used to recognize a fingerprint of the user. The fingerprint sensor 163 may be implemented as various forms of sensors. For example, the fingerprint sensor 163 may be an optical fingerprint recognition sensor that generates a reflection image reflecting a difference in reflectance between a valley and a mountain of the fingerprint by totally reflecting light irradiated from a light source onto the fingerprint using a lens and a prism. In addition, the fingerprint sensor 163 may be a capacitive fingerprint recognition sensor that measures a capacitance of the valley and the mountain of the fingerprint and implements the measured electrical signal as a digital image. In addition, the fingerprint sensor 163 may be a heat-sensitive fingerprint recognition sensor using a superconductive material that detects a temperature change by a difference of heat between the valley and the mountain of the fingerprint and generates an electrical signal when the fingerprint contacts.

The fingerprint sensor 163 may be disposed on at least one of the handles 21, 31, 41, and 51 of the door. For example, the fingerprint sensor 163 may include a contact surface for recognizing a fingerprint of a finger in a movable range in which the finger of the gripping hand may naturally touch the handle when the user grips the handles 21, 31, 41, and 51.

A fingerprint image obtained through the fingerprint sensor 163 may be used to identify the user.

The pressure sensor 164 may be disposed on a shelf of the refrigerator 10 and used to identify the weight of an object placed on the shelf. The pressure sensor 164 may be disposed in the form of an array on the shelf.

A plurality of pressure sensors 164 may be disposed at points where lines cross on the shelf 15 of the refrigerator. An array distance of the pressure sensor 164 may be 1 mm or less. The main processor 120 may identify the bottom surface shape and weight of the food placed on the shelf based on the pressure detected by the pressure sensor 164. In particular, the main processor 120 may identify which food is placed at which position based on the image captured by the internal camera 152 and the pressure detected by the pressure sensor 164.

In addition, the refrigerator may include various sensors. For example, the refrigerator may further include a sensor for detecting a door opening and closing of the refrigerator, an illumination sensor for detecting an amount of light around the refrigerator to adjust the brightness of the display 150, and the like.

The display 150 may provide (or display) a graphical user interface (GUI) corresponding to various services (e.g., voice call, video call, data transmission, broadcast reception, photography, video content viewing, or electronic payment including mobile payment).

The display 150 may include, for example, a liquid crystal display (LCD), a light-emitting diode (LED) display, an organic light-emitting diode (OLED) display (e.g., activematrix organic light-emitting diode (AMOLED) or passive-matrix OLED (PMOLED)), or a micro-electromechanical systems (MEMS) display.

The inputter 175 may receive a user input and transmit the user input to the main processor 120. The inputter 175 may be, for example, at least one of a touch sensor, a (digital) pen sensor, a pressure sensor, or a key. The touch sensor may use at least one of, for example, a capacitive manner, a resistive manner, an infrared manner, or an ultrasonic manner. The (digital) pen sensor may be, for example, a portion of a touch panel or may include a separate recognition sheet. The key may include, for example, a physical button, an optical key, or a keypad.

The display 150 and the touch sensor of the inputter 175 may form a mutual layer structure and be implemented as a touch screen.

For example, the main processor 120 may display a selected shortcut icon (or also referred to as an icon) from among shortcut icons corresponding to an application displayed on the touch screen 170 to be separated from other unselected shortcut icons or may display a video application screen on the display 150 by executing an application (e.g., a video application) corresponding to the selected shortcut icon, in response to a touch input from the display 150 implemented as the touch screen.

The driver 180 may include a compressor 181, a fan 182, a filter 183, or a heater 184 operating under the control of the main processor 120. The driver 180 may further include a lighting (not illustrated) or an odor deodorizer (not illustrated).

The compressor 181 may compress the refrigerant that is a working fluid of a refrigeration cycle under the control of the main processor 120. The refrigeration cycle may include a condenser (not illustrated) for converting a gaseous refrigerant compressed by the compressor 181 into a liquid refrigerant, an expander (not illustrated) for decompressing the liquid refrigerant, and a vaporizer (not illustrated) for a vaporizing the decompressed liquid refrigerant. The main processor 120 may control the temperature of the storage compartment through the vaporization of the liquid refrigerant. In addition, the refrigerator may control the temperature of the storage compartment through a Peltier element (not illustrated) using a Peltier effect and a magnetic cooling device (not illustrated) using a magnetocaloric effect.

The fan 182 may circulate outside air under the control of the main processor 120. The air heated by the cooling cycle may be cooled by heat exchange through the outside air.

The filter 183 may sterilize (or remove) bacterium suspended in or attached to the storage compartment under the control of the main processor 120. The filter 183 may include an ion sterilization cleaner.

The heater 184 may remove generated frost under the control of the main processor 120. The heater 184 may include a defrost heater.

The power supply 195 may supply power to the components of the refrigerator under the control of the main processor 120. The power supply 195 may supply power input from an external power source through a power code (not illustrated) to the respective components of the refrigerator under the control of the main processor 120.

The memory 196 may store various data, control programs or applications for driving and controlling the refrigerator.

The memory 196 may include an internal memory or an external memory.

The internal memory may include at least one of, for example, a volatile memory (for example, a dynamic random access memory (DRAM), a static RAM (SRAM), a synchronous dynamic RAM (SDRAM), or the like), a non-volatile memory (for example, a one time programmable read only memory (OTPROM), a programmable ROM (PROM), an erasable and programmable ROM (EPROM), an electrically erasable and programmable ROM (EEPROM), a mask ROM, a flash ROM, or the like), a flash memory (for example, a NAND flash, a NOR flash, or the like), a hard drive, or a solid state drive (SSD)).

The external memory may include a flash drive such as a compact flash (CF), a secure digital (SD), a micro secure digital (Micro-SD), a mini secure digital (Mini-SD), an extreme digital (xD), a multi-media card (MMC), a memory stick, or the like. The external memory may be functionally and/or physically connected to the refrigerator through various interfaces.

The memory 196 may be accessed by the main processor 120, and readout, writing, correction, deletion, update, and the like of data in the memory 196 may be performed by the main processor 120. In the disclosure, a term 'memory' includes the memory 196, a read only memory (ROM) 122 in the main processor 120, a random access memory (RAM) 121, or a memory card (e.g., a micro secure digital (SD) card or a memory stick) mounted in the refrigerator.

The memory 196 may store computer executable instructions for performing a controlling method of a refrigerator to be described in the disclosure.

The memory 196 may store a signal or data (e.g., data corresponding to food management (or food recognition)) input/output according to the operation of the components under the control of the main processor 120. The memory 196 may store graphical user interfaces (GUIs) related to control programs for control of the refrigerator or the main processor 120 and applications provided by a manufacturer or downloaded from the outside (e.g., a food management application, a food recognition application, a food purchase application, a food reminder application, a morning brief application, and the like), images corresponding to the GUIs, food information, user information, documents, databases, or related data.

The memory 196 may include software and/or firmware configured as one or more modules. The module may correspond to a set of computer executable instructions.

Figure 5:
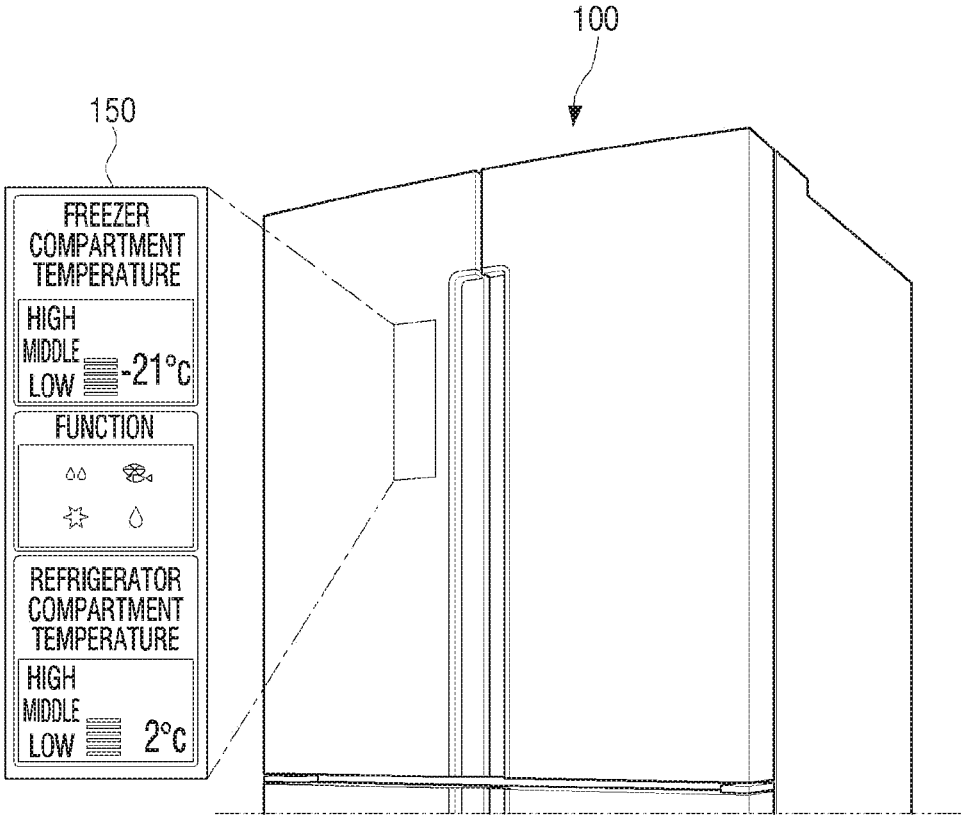
FIG. 5 is a view illustrating an external display according to an embodiment of the disclosure.

FIG. 5 is a view illustrating an external display according to an embodiment of the disclosure.

Referring to FIG. 5, the home appliance 100 may correspond to the refrigerator. The home appliance 100 may include an external display. The external display may display a freezer compartment temperature and a refrigerator compartment temperature. In addition, the external display may display information indicating a current operation mode, a function, or the like of the home appliance 100.

Meanwhile, in FIG. 5, the external display is displayed at a specific location, but this is only an example, and the external display may be located anywhere in the home appliance 100. In addition, the external display may be implemented in various ways such as an LED or an LCD.

Figure 6:
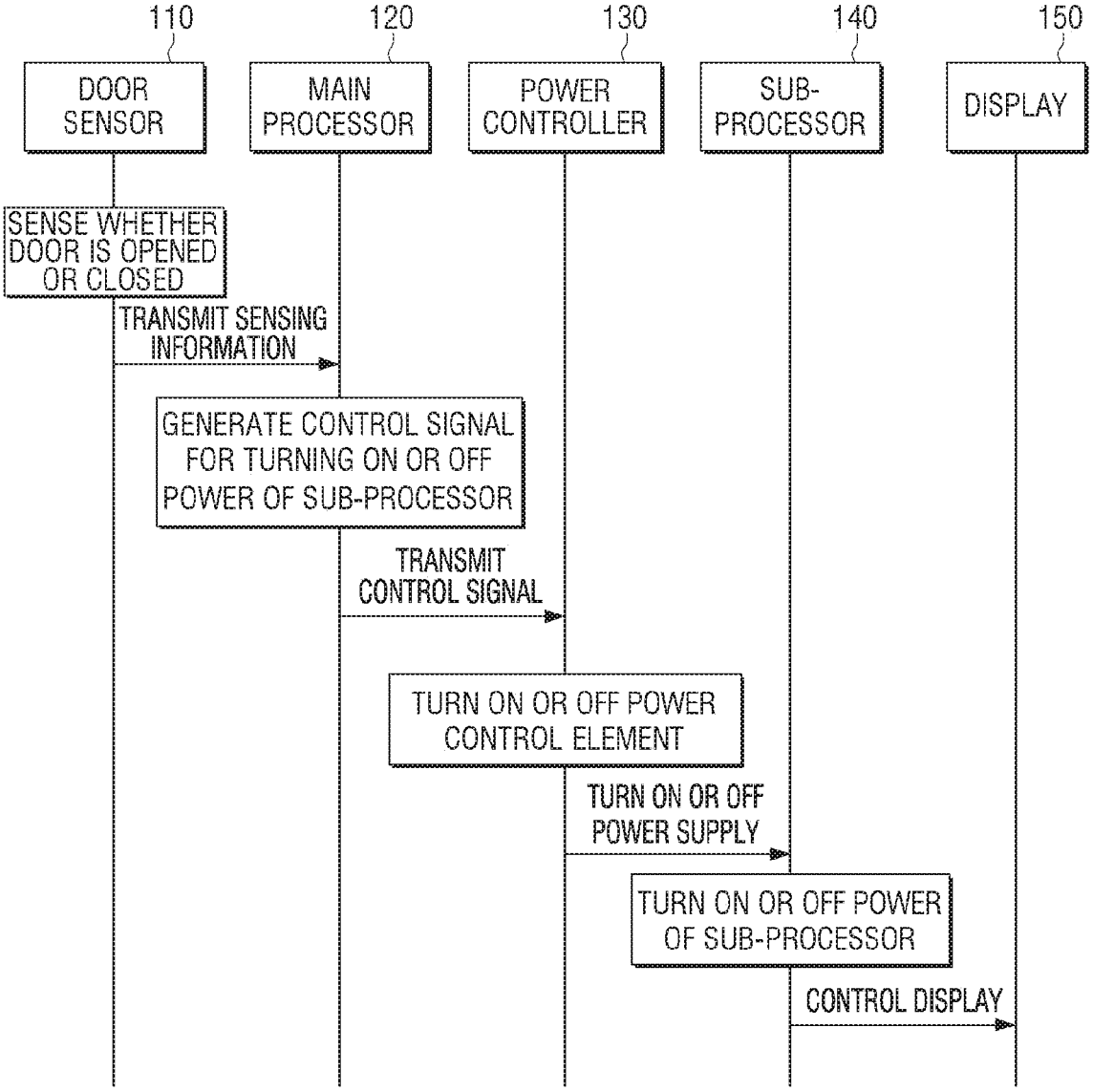
FIG. 6 is a sequence view illustrating a controlling method of a display according to an embodiment of the disclosure.

FIG. 6 is a sequence view illustrating a controlling method of a display according to an embodiment of the disclosure.

Referring to FIG. 6, the home appliance 100 may sense whether the door of the home appliance 100 is opened or closed through the door sensor 110. The door sensor 110 may sense whether the door of the home appliance 100 is in an opened state or a closed state. In addition, the main processor 120 may identify how many seconds the door is opened. In addition, the main processor 120 may identify how many seconds the door is closed. Specifically, when the door sensor 110 senses the door opening state, the door sensor 110 may transmit the corresponding sensing information to the main processor 120.

The main processor 120 may generate a control signal for turning on or off the power of the sub-processor 140 based on the sensing information received from the door sensor 110. In addition, the main processor 120 may transmit the control signal for turning on or off the power of the sub-processor 140 to the power control element 130.

The power control element 130 may be turned on or off based on the control signal received from the main processor 120. The power control element 130 may supply or interrupt the power to the sub-processor 140.

The power of the sub-processor 140 may be turned on or off depending on whether the power transferred from the power control element 130 is supplied.

If the power of the sub-processor 140 is in an on state, the sub-processor 140 may control an operation of the display 150.

Figure 7:
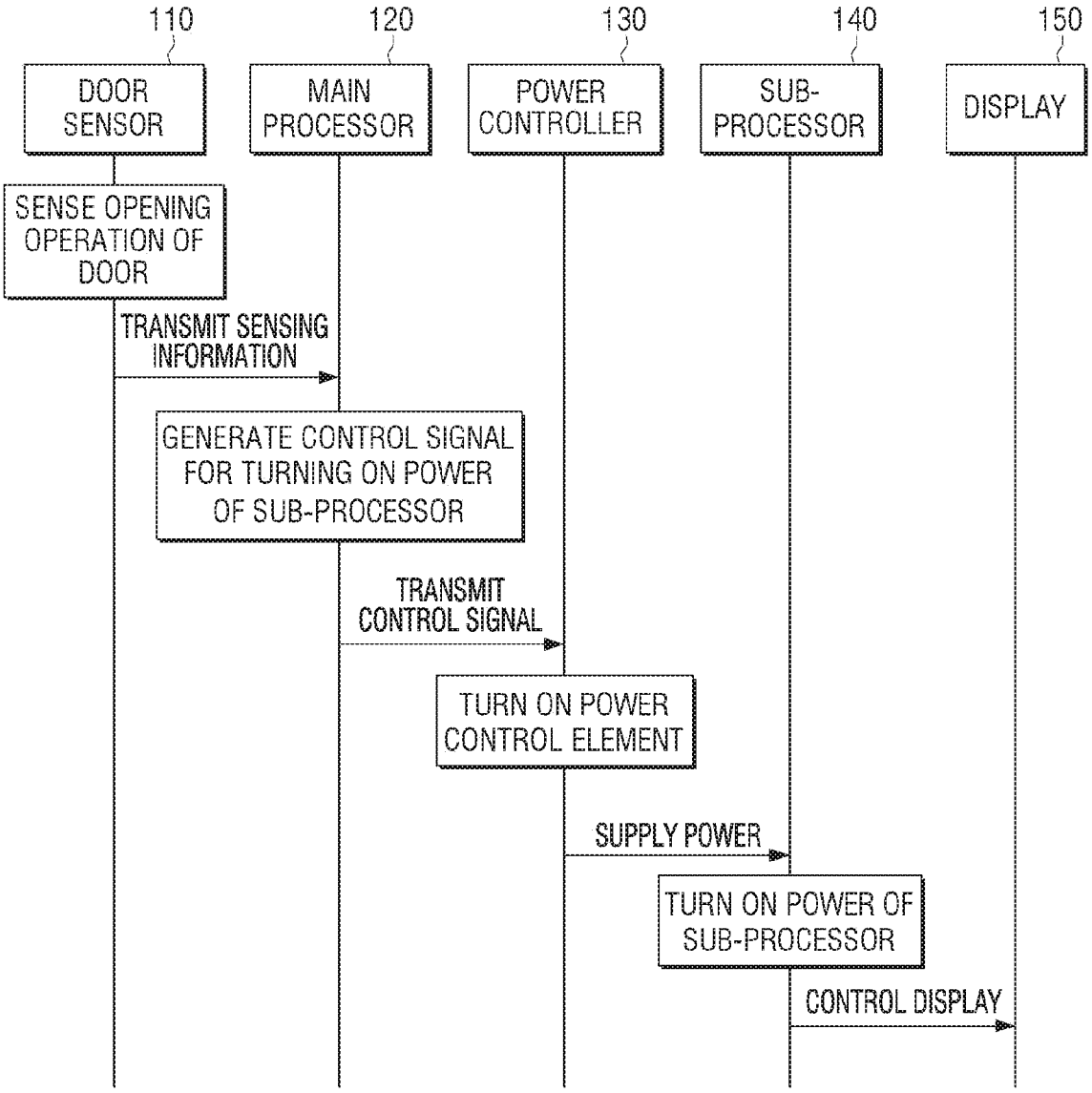
FIG. 7 is a sequence view illustrating an example in which an opening operation of a door is sensed.
Figure 8:
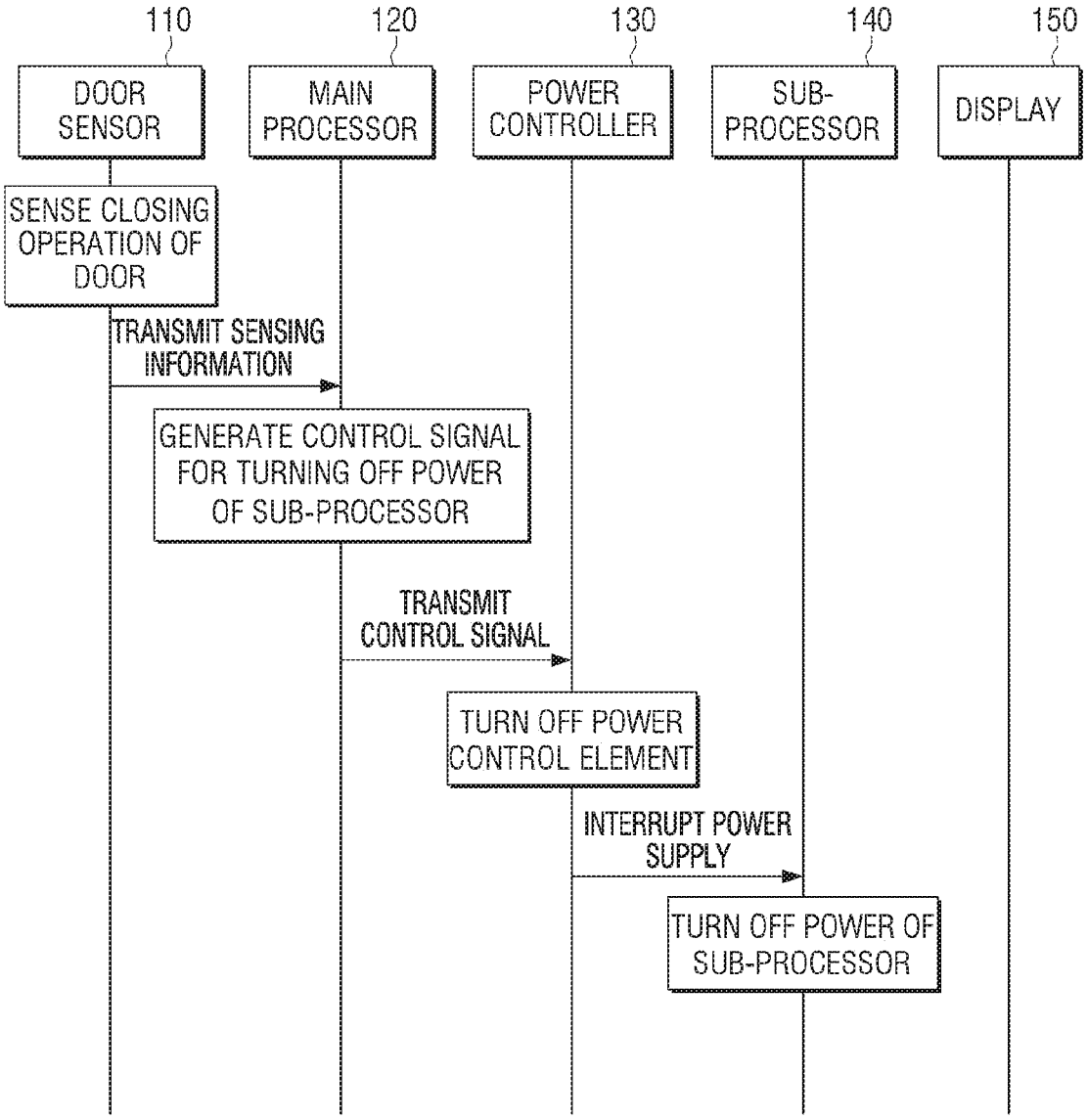
FIG. 8 is a sequence view illustrating an example in which a closing operation of the door is sensed.

In FIG. 6, a general operation according to an embodiment of the disclosure has been schematically described. In FIGS. 7 and 8, an operation according to information sensed by the door sensor 110 or the proximity sensor 161 will be described in detail.

FIG. 7 is a sequence view illustrating an example in which an opening operation of a door is sensed.

Referring to FIG. 7, the door sensor 110 may sense an opening operation of the door of the home appliance 100. For example, when the user opens the door of the home appliance 100, the door sensor 110 may obtain sensing information corresponding to the corresponding content.

In addition, the door sensor 110 may transmit the sensing information indicating the opening operation of the door to the main processor 120.

The main processor 120 may generate a control signal for turning on the power of the sub-processor 140 based on the sensing information received from the door sensor 110. For example, when the user opens the door, the main processor 120 may generate the control signal for turning on the power of the sub-processor 140. In addition, the main processor 120 may transmit the control signal for turning on the power of the sub-processor 140 to the power control element 130.

The power control element 130 may change a state of the power control element 130 from an off state to an on state based on the control signal received from the main processor 120.

In addition, if the power control element 130 receives the control signal for turning on the power of the sub-processor 140 from the main processor 120, the power control element 130 may supply the power to the sub-processor 140.

If the sub-processor 140 is supplied with the power from the power control element 130, the power of the sub-processor 140 may be changed from the off state to the on state. In addition, if the power of the sub-processor 140 is turned on, the sub-processor 140 may control an operation of the display 150. Here, when the power of the sub-processor 140 is turned on, the power of the display 150 is not necessarily changed to the on state, and the sub-processor 140 may directly control the power of the display 150 to be turned on or off.

That is, the sub-processor 140 may change the power of the display 150 from the on state to the off state or from the off state to the on state. In addition, the sub-processor 140 may transmit information displayed on the display 150 to the display 150.

FIG. 8 is a sequence view illustrating an example in which a closing operation of the door is sensed.

Referring to FIG. 8, the door sensor 110 may sense a closing operation of the door of the home appliance 100. For example, when the user closes the door of the home appliance 100, the door sensor 110 may obtain sensing information corresponding to the corresponding content.

In addition, the door sensor 110 may transmit the sensing information indicating the closing operation of the door to the main processor 120.

The main processor 120 may generate a control signal for turning off the power of the sub-processor 140 based on the sensing information received from the door sensor 110. For example, when the user closes the door, the main processor 120 may generate the control signal for turning off the power of the sub-processor 140. In addition, the main processor 120 may transmit the control signal for turning off the power of the sub-processor 140 to the power control element 130.

The power control element 130 may change a state of the power control element 130 from an on state to an off state based on the control signal received from the main processor 120.

In addition, if the power control element 130 receives the control signal for turning off the power of the sub-processor 140 from the main processor 120, the power control element 130 may interrupt the power supply to the sub-processor 140.

If the sub-processor 140 is not supplied with the power from the power control element 130, the power of the sub-processor 140 may be changed from the on state to the off state. If the sub-processor 140 is not supplied with the power, the power state of the sub-processor 140 may be changed from the on state to the off state. If the power of the sub-processor 140 is in the off state, the power of the display 150 may also be in the off state. In addition, if the power of the sub-processor 140 is in the off state, the sub-processor 140 may not control the display 150. For example, if the power of the sub-processor 140 is in the off state, the sub-processor 140 may not change the power of the display 150 from the off state to the on state.

In FIGS. 7 and 8, the operation in which the power state of the sub-processor 140 is changed based on the information sensed by the door sensor 110 has been described. However, according to another embodiment of the disclosure, the power state of the sub-processor 140 may be determined according to information sensed by the proximity sensor 161.

Figure 9:
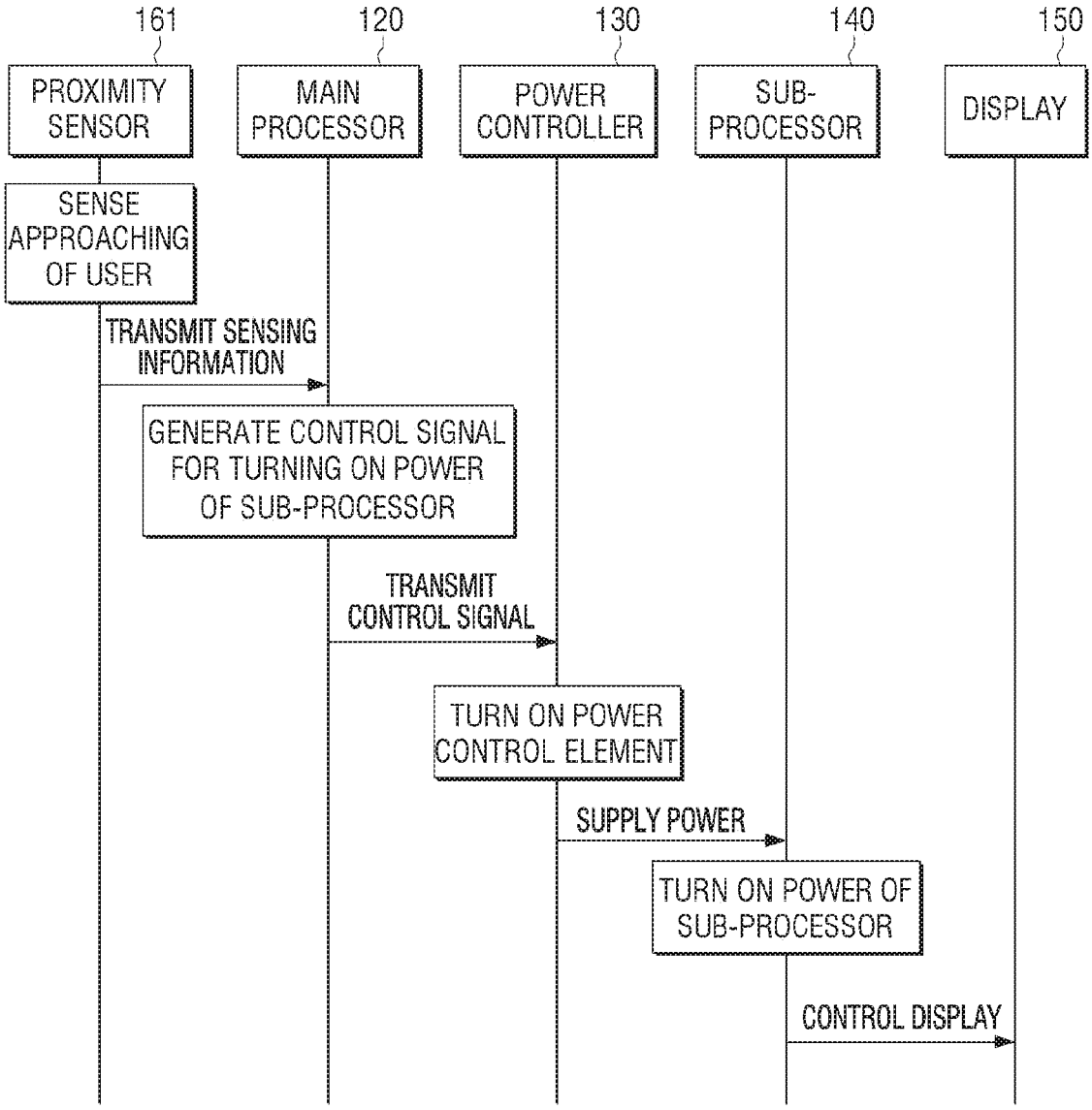
FIG. 9 is a sequence view illustrating an example in which an approaching operation of a user is sensed.

FIG. 9 is a sequence view illustrating an example in which an approaching operation of a user is sensed.

Referring to FIG. 9, the proximity sensor 161 may sense an approaching operation of a user. For example, when the user approaches the home appliance 100, the proximity sensor 161 may obtain sensing information corresponding to the corresponding content.

In addition, the proximity sensor 161 may transmit the sensing information indicating the approaching of the user to the main processor 120.

The main processor 120 may generate a control signal for turning on the power of the sub-processor 140 based on the sensing information received from the proximity sensor 161. For example, when the user approaches the home appliance 100, the main processor 120 may generate the control signal for turning on the power of the sub-processor 140. In addition, the main processor 120 may transmit the control signal for turning on the power of the sub-processor 140 to the power control element 130.

Subsequent operations may be the same as those described with reference to FIG. 7.

The power control element 130 may change a state of the power control element 130 from an off state to an on state based on the control signal received from the main processor 120.

In addition, if the power control element 130 receives the control signal for turning on the power of the sub-processor 140 from the main processor 120, the power control element 130 may supply the power to the sub-processor 140.

If the sub-processor 140 is supplied with the power from the power control element 130, the power of the sub-processor 140 may be changed from the off state to the on state. In addition, if the power of the sub-processor 140 is in the on state, the sub-processor 140 may control an operation of the display 150. Here, when the power of the sub-processor 140 is turned on, the power of the display 150 is not necessarily changed to the on state, and the sub-processor 140 may directly control the power of the display 150 to be turned on or off.

That is, the sub-processor 140 may change the power of the display 150 from the on state to the off state or from the off state to the on state. In addition, the sub-processor 140 may transmit information displayed on the display 150 to the display 150.

Meanwhile, although only one of the door sensor 110 and the proximity sensor 161 has been described as being used in describing FIGS. 7 to 9, a plurality of sensing information may be used in combination. The home appliance 100 may use both door sensing information and user approaching sensing information to determine the power state of the sub-processor 140. For example, only when both the approaching of the user and the open state of the door are sensed, the home appliance 100 may control to turn on the power of the sub-processor 140.

Figure 10:
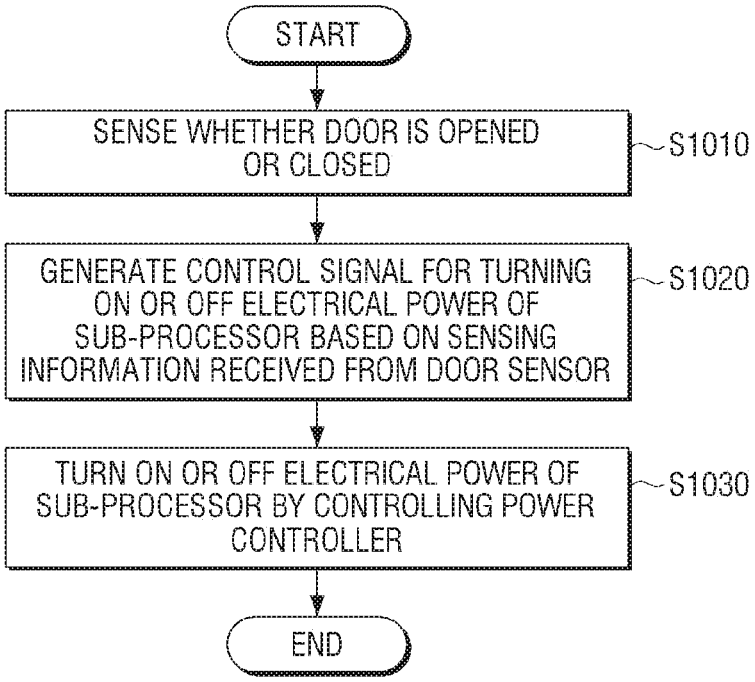
FIG. 10 is a flowchart illustrating a controlling method of a home appliance according to an embodiment of the disclosure.

FIG. 10 is a flowchart illustrating a controlling method of a home appliance 100 according to an embodiment of the disclosure.

The controlling method of the home appliance 100 including the main processor 120 and the sub-processor 140 controlling a display operation of the display 150 may sense whether the door is opened or closed (S1010).

In addition, the main processor 120 may generate a control signal for turning on or off the power of the sub-processor 140 based on the sensing information received from the door sensor 110 (S1020).

In addition, the main processor 120 may turn on or off the power of the sub-processor 140 by controlling the power control element 130 according to the control signal (S1030).

Here, the power control element 130 may be a switching element disposed between the power supply 195 and the sub-processor 140. In addition, in the turning on or off of the power of the sub-processor 140 (S1030), the power of the sub-processor 140 may be turned on or off by turning on or off the switching element based on the control signal.

Meanwhile, the power control element 130 may be a chip module disposed between the power supply 195 and the sub-processor 140. In addition, in the turning on or off of the power of the sub-processor 140 (S1030), the power of the sub-processor 140 may be turned on or off by transmitting the control signal to the chip module.

Meanwhile, when a control signal for turning off the sub-processor 140 is received from the power control element 130, the sub-processor 140 may turn off power of the display 150.

Meanwhile, the display 150 may be an internal display 150 provided inside the home appliance 100, and in the generating of the control signal (S1020), when the door sensor 110 senses a door opening operation, a first control signal for turning on the power of the sub-processor 140 may be generated. In addition, in the generating of the control signal (S1020), when the door sensor 110 senses a door closing operation, a second control signal for turning off the power of the sub-processor 140 may be generated.

Meanwhile, the display 150 may be an external display 150 provided outside the home appliance 100. Here, in the generating of the control signal (S1020), in the state in which the power of the sub-processor 140 is turned off, when the motion sensor senses an approaching of the user, the first control signal for turning on the power of the sub-processor 140 may be generated.

Meanwhile, the home appliance 100 may further include an inputter, and the sub-processor 140 may control a display operation of the display 150 based on a user manipulation command input by the inputter.

Meanwhile, the home appliance 100 may control the sub-processor 140 to be in a power off state or a low power state in a predetermined first time interval zone.

Meanwhile, when the door sensor 110 senses the door closing operation in a predetermined second time interval zone, the home appliance 100 may control the sub-processor 140 to be in the low power state.

Meanwhile, the home appliance 100 may be implemented as a refrigerator, and in the controlling method of the home appliance 100, the sub-processor 140 may control the display 150 to display temperature information of the refrigerator.

On the other hand, the methods according to the diverse embodiments of the disclosure described above may be implemented in the form of applications installable on existing home appliances 100.

In addition, the methods according to the diverse embodiments of the disclosure described above may be implemented by only upgrading software or hardware of the existing home appliances 100.

In addition, the diverse embodiments of the disclosure described above may also be performed through an embedded server included in the home appliance 100, or an external server of the home appliance 100.

On the other hand, the controlling method of the home appliance 100 according to the embodiment described above may be implemented by a program and provided to the home appliance 100. In particular, the program including the controlling method of the home appliance 100 may be stored in a non-transitory computer readable medium and provided.

In addition, the diverse embodiments described above may be implemented in a computer or similar device readable recording medium using software, hardware, or a combination of thereof. According to a hardware implementation, the embodiments described in the disclosure may be implemented using at least one of application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, or electric units for performing other functions. In some cases, the embodiments described in the disclosure may be implemented as the processor 120 itself. According to a software implementation, the embodiments such as procedures and functions described in the disclosure may be implemented as separate software modules. Each of the software modules may perform one or more functions and operations described in the disclosure.

Meanwhile, computer instructions for performing processing operations of the home appliance 100 according to the diverse embodiments of the disclosure described above may be stored in a non-transitory computer-readable medium. The computer instructions stored in the non-transitory computer-readable medium allow a specific device to perform the processing operations of the home appliance 100 according to the diverse embodiments described above when being executed by a processor of the specific device.

The non-transitory computer-readable medium refers to a medium that stores data semi-permanently and is read by a device, not a medium storing data for a short time such as a register, a cache, a memory, and the like. A specific example of the non-transitory computer-readable medium may include a compact disk (CD), a digital versatile disk (DVD), a hard disk, a Blu-ray disk, a universal serial bus (USB), a memory card, a read only memory (ROM), or the like.

Although the embodiments of the disclosure have been illustrated and described hereinabove, the disclosure is not limited to the abovementioned specific embodiments, but may be variously modified by those skilled in the art to which the disclosure pertains without departing from the gist of the disclosure as disclosed in the accompanying claims. These modifications should also be understood to fall within the scope and spirit of the disclosure.

What is claimed is:

1. A home appliance comprising:

a door;

a door sensor configured to sense whether the door is opened or closed;

a display;

a main processor;

a sub-processor configured to control a display operation of the display; and a power controller configured to switch a supply of electrical power to the sub-processor between an on state and an off state to thereby switch the display operation of the display between an on state and an off state, wherein the main processor is configured to:

receive a signal from the door sensor indicating whether the door is opened or closed, generate a first control signal for the power controller to turn on the supply of the electrical power to the sub-processor based on the signal received from the door sensor indicating a door opening operation, generate a second control signal for the power controller to turn off the electrical power to the sub-processor based on the signal received from the door sensor indicating a door closing operation; and control the power controller to switch the supply of electrical power to the sub-processor according to the first control signal and the second control signal.

2. The home appliance as claimed in claim 1, further comprising a power supply, wherein the power controller is a switching element disposed between the power supply and the sub-processor, the main processor is configured to turn on the supply of the electrical power to the sub-processor by turning on the switching element according to the first control signal, and the main processor is configured to turn off the supply of the electrical power to the sub-processor by turning off the switching element according to the second control signal.

3. The home appliance as claimed in claim 1, further comprising a power supply, the power controller is a chip module disposed between the power supply and the sub-processor, the main processor is configured to turn on the supply of the electrical power to the sub-processor by transmitting the first control signal to the chip module, and the main processor is configured to turn off the supply of electrical power to the sub-processor by transmitting the second control signal to the chip module.

4. The home appliance as claimed in claim 1, wherein the sub-processor turns off power of the display based on the second control signal.

5. The home appliance as claimed in claim 1, wherein the display is an internal display provided inside the home appliance.

6. The home appliance as claimed in claim 1, further comprising a motion sensor, wherein the display is an external display provided outside the home appliance, and the main processor is further configured to generate the first control signal to turn on the supply of the electrical power to the sub-processor based on an approach of a user sensed by the motion sensor in a state in which the electrical power to the sub-processor is turned off.

7. The home appliance as claimed in claim 1, further comprising an interface, wherein the sub-processor is further configured to control the display operation of the display based on a user manipulation command input by the interface.

8. The home appliance as claimed in claim 1, wherein the main processor is further configured to control the sub-processor so as to lower a power supply to the sub-processor or to completely power off the sub-processor, during a predetermined time interval which is set by a user or set through artificial learning, and the predetermined time interval corresponds to a time interval during a day in which the home appliance is determined to not be used by the user.

9. The home appliance as claimed in claim 1, wherein the main processor is further configured to control the sub-processor so as to immediately lower a power supply to the sub-processor or immediately completely power off the sub-processor, in response to a door closing operation sensed by the door sensor at a time which is within predetermined time interval of a day, and the predetermined time interval corresponds to a time interval during the day in which the home appliance is determined to not be used by the user.

10. The home appliance as claimed in claim 1, wherein the home appliance is implemented as a refrigerator, and the sub-processor is further configured to control the display to display temperature information of the refrigerator.

11. A controlling method of a home appliance including a main processor and a sub-processor, the controlling method comprising:

sensing whether a door included in the home appliance is opened or closed using a door sensor of the home appliance, as sensing information;

generating, by the main processor, a first control signal for turning on electrical power to the sub-processor based on the sensing information received from the door sensor indicating a door opening operation;

generating, by the main processor, a second control signal for turning off the electrical power to the sub-processor based on the sensing information received from the door sensor indicating a door closing operation;

turning on the electrical power of the sub-processor by controlling a power controller of the home appliance according to the first control signal to thereby turn on a display operation of a display; and turning off the electrical power of the sub-processor by controlling the power controller of the home appliance according to the second control signal to thereby turn off the display operation of the display.

12. The controlling method as claimed in claim 11, wherein the power controller is a switching element disposed between a power supply and the sub-processor, turning on the electrical power to the sub-processor includes turning on the switching element based on the first control signal, and turning off the electrical power to the sub-processor includes turning off the switching element based on the second control signal.

13. The controlling method as claimed in claim 11, wherein the power controller is a chip module disposed between a power supply and the sub-processor, and turning on of the electrical power to the sub-processor includes transmitting the first control signal to the chip module, and turning off the electrical power to the sub-processor includes transmitting the second control signal to the chip module.

14. The controlling method as claimed in claim 11, further comprising turning off, by the sub-processor, electrical power of the display based on the second control signal.

15. The controlling method as claimed in claim 11, wherein the display is an internal display provided inside the home appliance.

16. The controlling method as claimed in claim 11, wherein the display is an external display provided outside the home appliance, and generating, by the main processor, the first control signal for turning on the electrical power to the sub-processor is further based on an approach of a user sensed by a motion sensor in a state in which the electrical power to the sub-processor is turned off.

17. The controlling method as claimed in claim 11, further comprising controlling, by the sub-processor, the display operation of the display based on a user manipulation command input by an interface.

18. The controlling method as claimed in claim 11, further comprising controlling the sub-processor so as to lower a power supply to the sub-processor or completely power off the sub-processor, during a predetermined time interval which is set by a user or set through artificial learning, wherein the predetermined time interval corresponds to a time interval during a day in which the home appliance is determined to not be used by the user.

19. The controlling method as claimed in claim 11, further comprising controlling the sub-processor so as to immediately lower a power supply to the sub-processor or immediately completely power off the sub-processor, in response to a door closing operation sensed by the door sensor at a time which is within a predetermined time interval of a day, wherein the predetermined time interval corresponds to a time interval during the day in which the home appliance is determined to not be used by the user.

20. The controlling method as claimed in claim 11, wherein the home appliance is implemented as a refrigerator, and the controlling method further includes controlling, by the sub-processor, the display to display temperature information of the refrigerator.

* * * * *